United States Patent [19]

Schwarz

[11] 4,118,683

[45] Oct. 3, 1978

[54] RESETTABLE THERMAL SAFETY SWITCH

[75] Inventor: Gerhard Schwarz, Pforzheim, Fed. Rep. of Germany

[73] Assignee: Firma Microtherm GmbH, Pforzheim, Fed. Rep. of Germany

[21] Appl. No.: 811,789

[22] Filed: Jun. 30, 1977

[30] Foreign Application Priority Data

Jun. 30, 1976 [DE] Fed. Rep. of Germany ..... 2629380

[51] Int. Cl.[2] ..... H01H 61/00

[52] U.S. Cl. ..... 337/91; 337/94; 337/348

[58] Field of Search ..... 337/89, 91, 94, 365, 337/367, 368, 346, 347, 348

[56] References Cited

U.S. PATENT DOCUMENTS 4,059,817 11/1977 Hollweck et al. ..... 337/367

*Primary Examiner*—George Harris

*Attorney, Agent, or Firm*—Joseph A. Geiger

[57] ABSTRACT

A resettable thermal safety switch having a bistable domed bimetallic disc serving as a heat-responsive switching element which pops from its normal curvature to an opposite curvature, thereby moving a contact breaking plate, the switch having a reset button which is arranged to return the disc to its normal state and to close the switch, but between the reset button and the moving parts of the switch is arranged a force-limiting assembly which prevents resetting or blocking of the switching action at the critical temperature.

10 Claims, 2 Drawing Figures

RESETTABLE THERMAL SAFETY SWITCH

BACKGROUND OF THE INVENTION

1. Field of the Invention

The present invention relates to temperature-responsive safety switches, and, more particularly, to safety switches which, following the partial or total disappearance of the switch-actuating temperature condition, are manually resettable.

2. Description of the Prior Art

Safety considerations make it desirable that the circuit-interrupting action of resettable thermal safety switches cannot be suppressed through manipulation of, or tampering with the resetting mechanism of the safety switch. This means that, when the critical temperature level is reached, the bimetallic control member of the switch must be free to execute the contact-opening movement, even if the reset button is fully depressed, either momentarily or permanently. Only when this condition of switching freedom is met, is the thermal safety switch tamper-proof and operationally independent from the resetting mechanism, in the sense of a true safety switch.

SUMMARY OF THE INVENTION

Underlying the present invention is the primary objective of devising an improved thermal safety switch which, while being of simple construction, meets the above-mentioned safety requirements.

In order to attain this objective, the present invention suggests an improved resettable thermal safety switch which has a special reset control means associated with its reset mechanism, so as to limit the force which the reset mechanism can transmit to the switching elements, while at the same time also limiting the mobility of the reset button.

The novel reset control means is preferably a reset control assembly which is arranged between the reset button and the switching elements and which includes a force-limiting compression spring and a stroke-limiting abutment for the reset button. The compression spring of the reset control assembly is preferably arranged between a shell which is solidary with the reset button and a reset plunger which protrudes from the hollow plug in the direction of engagement with the switching elements.

The compression spring, which is preferably mounted in a preloaded state inside the shell of the reset control assembly, is so calibrated that, on the one hand, the spring preload is sufficient to effect resetting of the switching elements at a normal temperature, but that, on the other hand, the compression spring will yield to the switching force of the temperature-responsive bimetallic switching element, when the latter reaches the critical temperature. This means that, after the safety switch has responded to an overheating condition by interrupting an electrical circuit, the temperature will have to fall by at least a certain amount, before a resetting movement of the reset button will be transmitted to the switching elements. It also signifies that, in case the reset button, for some reason or other, is blocked in the depressed position, it will not prevent the safety switch from responding to the critical temperature by opening the circuit.

The temperature-responsive bimetallic switching element is preferably of the statically bistable type, having the shape of a disc whose initially flat midportion is prestressed, so that the disc is forced to assume a dome-shaped outline, bulging either inwardly or outwardly and being stable in both conditions. The bimetallic layers of the disc are so arranged that, upon reaching a certain temperature, the heat-induced differential stress in the disc will cause it to "pop" from one stable state into the other stable state in which the disc will remain until it is reset to the first state, under the application of an exterior resetting force. Alternatively, the bimetallic disc may be arranged to return automatically from its popped state to the normal state after a certain temperature drop.

BRIEF DESCRIPTION OF THE DRAWINGS

Further special features and advantages of the invention will become apparent from the description following below, when taken together with the accompanying drawing, which illustrates, by way of example, a preferred embodiment of the invention, represented in the various figures as follows.

DESCRIPTION OF THE PREFERRED EMBODIMENT

Figure 1:
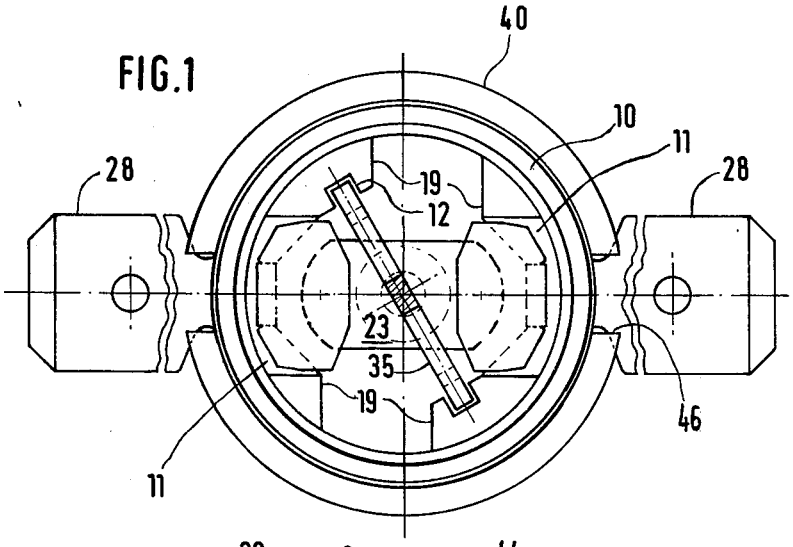
FIG. 1 is a frontal view of a cross-sectioned resettable safety switch embodying the present invention, the cross section being taken along line I—I of FIG. 2.
Figure 2:
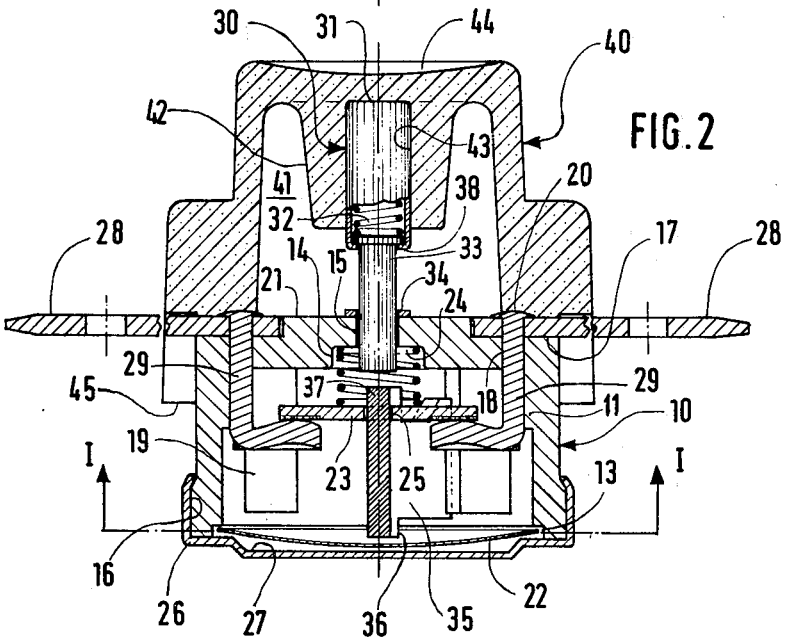
FIG. 2 shows the safety switch of FIG. 1, as seen in a longitudinal cross section.

Referring to FIGS. 1 and 2 of the drawing, there is shown a resettable thermal safety switch representing a preferred embodiment of the present invention. This switch is assembled around a cup-shaped housing 10 of electrically nonconductive material, the housing consisting essentially of a generally cylindrical side wall which defines a circular opening on one axial end and which adjoins a housing bottom 21 at the other axial end. In the center of the housing bottom 21 is arranged an axial guide bore 15, surrounded on the inner side of the bottom 21 by a counterbore 14.

At the open end of the housing 10 is arranged a small radially inwardly facing rim recess 13, the housing rim itself supporting a cover 26. The latter is preferably a sheet metal stamping, having a cross-sectional outline which defines a concavity 27 of a diameter which is somewhat smaller than the diameter of the rim recess 13. The cover 26 is permanently attached to the housing 10 by engaging a peripheral flange 16 of the latter, the edge of the cover being crimped over the peripheral flange 16.

The annular groove which is defined by the rim recess 13 and the adjoining cover 26 serves as a peripheral retaining groove for a circular bimetallic disc 22 whose normal shape is as shown in FIG. 2, defining a shallow dome with a curvature that dips axially into the dish-shaped concavity 27 of cover 26. The bimetallic disc responds to a rise in temperature by an initial buildup of internal stress which, when the critical temperature is reached or exceeded, causes the disc to "pop" into a dome shape of oppositely curved outline.

On the other side of the housing bottom 21 are provided two diametrically opposite radially oriented positioning grooves 17 into which are engaged two metallic connector lugs 28 which extend radially away from the housing 21. The connector lugs 28 are held in place by means of two contact brackets 29 which are arranged on the inside of the housing 10, reaching axially through appropriate apertures 18 of the housing bottom 21 and through similar apertures 20 of the connector lugs 28 to which they are permanently riveted. The contact brackets 29 have a generally L-shaped outline, an axial leg portion of each bracket being engaged in the aforementioned apertures 18 and 20 of the housing 10 and of the connector lugs 28, while enlarged radially oriented leg portions of the contact brackets 29 extend towards each other to form contact pads. While the axial leg portions of the contact brackets 29 are supported by bracket supports 11 of the housing 10, the radial leg portions of the brackets 29 engage axially oriented faces of the bracket supports 11, thereby firmly positioning the riveted contact brackets 29.

Against the axially inwardly facing contact pads of the contact brackets 29 rests an axially movable contact plate 23, under the bias of a compression spring 24. The opposite end of this spring 24 engages the counterbore 14 of the housing bottom 21, being thusly centered by the latter. In its normal position, shown in FIG. 2, the contact plate 23 establishes an electrical connection between the two contact brackets 29 and their attached connector lugs 28.

Inside the housing 10 are further arranged two diametrically opposite supporting ridges 19, extending radially inwardly from the housing side wall and reaching from the inside of the housing bottom 21 to a point near the rim recess 13, at the open end of the housing 10. These supporting ridges 19 are preferably arranged to adjoin the earlier-mentioned bracket supports 11, thereby contributing to the positioning of the contact brackets 29. In addition thereto, the supporting ridges 19 also form two diametrically opposite, radially inwardly facing axial guide grooves 12 for a slider plate 35.

The axially movable slider plate 35 has a substantially rectangular outline, occupying a diagonal position between the radial leg portions of the contact brackets 29 and having axially protruding central nose portions 36 and 37 on opposite axial ends, in alignment with the center axis of the assembly. While the inner nose portion 37 engages a matching oblong opening 25 in the contact plate 23, thereby positioning the latter, the outer nose portion 36 reaches axially to a point near the center point of the bimetallic disc 22.

It follows that, when the bimetallic disc 22 responds to the presence of a critical temperature condition by popping into the oppositely curved state, it pushes the slider plate 35 radially inwardly, thereby lifting the contact plate 23 from the contact pads of the contact brackets 29. Conversely, the slider plate 35 can be used to return the popped bimetallic disc 22 to its original normal position, in a resetting action which will be described further below.

Engaging the bottom end of the housing 10 is a reset cap 40 of resilient material, such as rubber, the cap 40 having an axially protruding skirt portion 45 with which it surrounds a portion of the housing side wall in a tightly fitting engagement. Suitable recesses 46 in the skirt portion 45 accommodate the radially extending connector lugs 28. The reset cap 40 thus forms an axial extension of the housing 10, a smaller central portion of the cap 40 serving as a finger-operable reset button. For this purpose, this smaller portion has an axial end face with a finger concavity 44.

In the cavity 41 of the reset cap 40 is arranged a sleeve-like axial extension 42 of the smaller button portion of the cap 40, the extension 42 having a blind bore 43 arranged in axial alignment with the guide bore 15 of the housing bottom 21. The blind bore 43 of the reset cap extension 42 holds a reset control assembly 30, consisting essentially of a tubular shell 31 engaged inside the blind bore 43, a smaller cylindrical reset plunger 33 protruding axially from the shell 31, and a compression spring 32 which is axially confined inside the shell 31 so as to bias the plunger 33 axially outwardly towards the nose portion 37 of the slider plate 35. For this purpose, the reset plunger 33 reaches through the guide bore 15 of the housing bottom 21.

The shell 31, spring 32, and plunger 33 of the reset control assembly 30 are permanently assembled in a crimping action at the open shell extremity 38. The latter forms a radially inwardly oriented collar retaining the reset plunger 33 by engaging an elarged end flange of the latter. The compression spring 32 thus holds the reset plunger 33 in the fully extended position, under a predetermined axial preload to which reference will be made further below, in connection with the operation of the safety switch.

FIG. 1 shows the normal operational configuration of the safety switch of the invention. In this position, the two connector lugs 28 are electrically connected over their contact bracket 29 and the contact plate 23, which is pressed against the contact pads of the brackets 29 by means of the compression spring 24. When the temperature of the switch reaches or exceeds a predetermined level, the bimetallic disc 22 inside the housing 10 responds by "popping", i.e. by suddenly changing its previous axially outwardly domed curvature to an axially inwardly domed curvature, thereby forcibly pushing the slider plate 35 ahead of it by engaging its outer nose portion 36.

The dimensions of the switch components are preferably so coordinated that, in the "popped" position of the bimetallic disc 22, the inner nose portion 37 of the slider plate 35 just about touches the aligned extremity of the reset plunger 33. As the slider plate 35 is displaced inwardly, it forces the contact plate 23 to execute the same displacement, in opposition to the compression spring 24, thereby breaking the contact at both contact brackets 29. If in this condition the reset button portion of the reset cap 40 is depressed in the axial direction, through the application of finger pressure to its concavity 44, the initial effect is an axial movement of the shell 31 of the reset control assembly and a corresponding axial compression of the spring 32, while the reset plunger 33 remains stopped against the inner nose portion 37 of the slider plate 35. This means that the combined forces of the compression spring 32 and of the compression spring 24 are still less than the force that would be required to pop the bimetallic disc back into its normal position. As the shell 31 of the reset control assembly is advanced further towards the housing bottom 21, a progressively increasing pressure is generated by the spring 32 which, at one point, will pop the bimetallic disc 22 back to its normal position. And, as the slider plate 35 moves axially outwardly, the compression spring 24 forces the contact plate 23 to follow the slider plate movement, thereby reestablishing a contact bridge between the contact brackets 29.

The force which is required to return the "popped" bimetallic disc 22 to its normal outwardly domed shape depends, of course, on the temperature of the bimetallic disc 22. Thus, the compression spring 32 of the reset control assembly can be calibrated in such a way that, as long as the critical temperature is present, no amount of compression of the reset control assembly will generate sufficient force to reset the popped bimetallic disc 22.

Since the maximum axial compression of the spring 32 of the reset control assembly 30 is determined by the maximum axial displaceability of its shell 31, the device has a builtin limit to the maximum resetting force which can be applied to the switching elements. This limit is reached, when the crimped extremity 38 of the shell 31 abuts against the back side of the housing bottom 21. By adjusting the maximum displaceability of the shell 31, through the interposition of one or more adjustment washers 34 between the housing bottom 21 and the shell extremity 38, the maximum resetting force can be conveniently increased or decreased.

Thus, if the spring 32 of the reset control assembly is appropriately calibrated, its maximum compressibility can be so adjusted that, as long as the critical temperature is present, the maximum resetting force under abutment of the shell 31 against the housing bottom 21 will not reset the bimetallic disc. Conversely, this relationship signifies that, if, for some reason or other, the reset control assembly 30 is depressed axially inwardly, the resetting bias acting on the reset plunger 33, in contact with the slider plate 35 will not be high enough to prevent the bimetallic disc 22 from popping inwardly at the critical temperature level.

The adjustability of the maximum resetting force which can be applied to the slider plate 35 over the reset control assembly 30 makes it possible to set the safety switch in such a way that it can only be reset, if the temperature has fallen a predetermined amount below the critical response temperature of the switch. The thermal safety switch of the invention, when adjusted in this manner, offers important safety advantages, inasmuch as it precludes tampering with the circuit interrupting switching elements by deliberate or accidental actuation of the resetting mechanism, and inasmuch as it precludes the resetting of the switch, until the temperature has fallen below a certain safety margin under the critical response temperature.

It should be understood, of course, that the foregoing disclosure describes only a preferred embodiment of the invention and that it is intended to cover all changes and modifications of this example of the invention which fall within the scope of the appended claims.

I claim the following:

1. A resettable thermal safety switch comprising in combination:

two separate stationary connector members over which a circuit can be laid on the switch;

a movable contact element guided for displacement between a normal position in which the element is in contact with both connector members, thereby closing said circuit, and a switched position in which the element is removed from at least one of the connector members, thereby opening said circuit;

a curved bimetallic temperature-responsive switching element which is statically bistable over a certain temperature range and which, upon reaching a predetermined temperature outside said range, pops from its normal curved shape into an oppositely curved shape, the bimetallic switching element being operatively connected to the contact element, so as to move the latter from its normal position to its switched position, when the bimetallic switching element pops from its state of normal curvature into said state of opposite curvature; and means for manually resetting the bimetallic switching element from its popped state to its normal state, the resetting means including: a manually accessible outer member whose resetting mobility is limited by an abutment, and an inner member which is guided to advance in the direction opposite to the direction in which the bimetallic switching element is poppable; and wherein said switching element resetting means includes means for transmitting a resetting force of limited maximum value from said outer member to said inner member, by yielding until the outer member reaches its abutment, when a higher than said limited force is required to effect resetting of the popped bimetallic switching element, said force transmitting means thereby allowing the bimetallic switching member to execute a popping movement, even when the outer member is held against its abutment.

2. A thermal safety switch as defined in claim 1, wherein said resetting force transmitting means includes a spring which is interposed between the manually accessible outer member and the guided inner member.

3. A thermal safety switch as defined in claim 2, wherein the switching element resetting means further includes a bore in its outer member;

the spring of the force transmitting means is a compression spring which is confined within said bore; and the inner member of said resetting means is a reset plunger having one extremity engaged in said bore, against one end of the compression spring, and the other extremity extending in said direction of advance.

4. A thermal safety switch as defined in claim 3, wherein said bore in the outer member of the resetting means is defined by a shell, the shell being attached to the outer member and having a bottom supporting the other end of the compression spring;

the reset plunger has an enlarged end flange with which it is engaged in said bore of the shell, so as to preload the compression spring;

the shell has a radially inwardly protruding collar cooperating with the end flange of the reset plunger to retain the latter inside the shell; and said shell, preloaded compression spring, and reset plunger form a reset control assembly in the form of a selfcontained subassembly.

5. A thermal safety switch as defined in claim 4, wherein the outer member of the resetting means is a reset button which is operable by finger pressure, against an opposing spring bias.

6. A thermal safety switch as defined in claim 4, wherein the reset button is part of a hollow cap of resiliently deformable material, having a stationary base and a depressible central button portion with a cavity accommodating therein the shell of the reset control assembly.

7. A thermal safety switch as defined in claim 1, wherein the abutment limiting the resetting mobility of the outer member of the resetting means is adjustable in its position relative to the outer member, for an increased or decreased resetting mobility, thereby correspondingly increasing or decreasing the maximum resetting force which can be transmitted from the outer member to the inner member.

8. A thermal safety switch as defined in claim 1, further comprising:

a cup-shaped stationary switch housing of electrically non-conductive material, the housing defining a longitudinal center axis and having a transverse bottom on one axial end and an opening circumscribed by a rim on the other axial end, a housing cover being attached to the latter; and wherein the two connector members are attached to the switch housing and include two contact pads inside the switch housing, at opposite sides of its longitudinal axis and facing towards the housing bottom;

the contact element includes a transversely oriented contact plate which is arranged axially between the housing bottom and the contact pads, abutting against the latter in its normal position, under the action of a spring which is interposed between the housing bottom and the contact plate;

the bimetallic switching element is a domed bimetallic disc with a circular periphery with which it is engaged in an annular groove of the switch housing, between its cover and the contact pads, the bimetallic disc being curved axially outwardly towards the housing cover in its normal state;

the manually accessible outer member of the switching element resetting means is a reset button which is arranged for movement in alignment with the housing axis, on the outer side of its bottom; and the switching element resetting means further includes, as part of its resetting force transmitting means, an axially oriented reset plunger which extends through a central guide bore of the housing bottom, in the direction of the contact element.

9. A thermal safety switch as defined in claim 8, wherein the switching element resetting means includes a hollow cap-shaped member of resiliently deformable material, having an enlarged base at which it is fixedly attached to the bottom of the switch housing, on the outer side of the latter; and the reset button is an axially depressible central portion of said cup-shaped member.

10. A thermal safety switch as defined in claim 8, wherein the switch housing further includes two diametrically opposite, radially inwardly facing axially extending guide grooves;

the contact element further includes a slider plate having edge portions engaged in said guide grooves, the slider plate cooperating with the contact plate with one axial extremity and with the bimetallic disc with the other axial extremity, so as to lift the contact plate away from the contact pads, to its switched position, when the bimetallic disc pops from its normal state to the opposite state.

* * * * *